US006860125B1

(12) United States Patent
Yu

(10) Patent No.: US 6,860,125 B1
(45) Date of Patent: Mar. 1, 2005

(54) NUMERAL LOCK STRUCTURE

(76) Inventor: Chun-Te Yu, No. 41-21, Kuan-Tsui St., Hsia-Nien Tsun, Fu-Hsing Hsiang, Changhua County (TW)

( * ) Notice: Subject to any disclaimer, the term of this patent is extended or adjusted under 35 U.S.C. 154(b) by 0 days.

(21) Appl. No.: 10/676,853

(22) Filed: Sep. 30, 2003

(30) Foreign Application Priority Data

Aug. 15, 2003 (TW) ..... 92214876 U

(51) Int. Cl.[7] ..... E05B 37/06
(52) U.S. Cl. ..... 70/25; 70/28; 70/312
(58) Field of Search ..... 70/25, 312, 27–29, 70/315–318

(56) References Cited

U.S. PATENT DOCUMENTS 1,857,399 A * 5/1932 Umberto ..... 70/27
1,940,789 A * 12/1933 Diaz ..... 70/25
2,008,565 A * 7/1935 Segal ..... 70/25
4,111,014 A * 9/1978 Epstein ..... 70/25
4,860,561 A * 8/1989 Hwang ..... 70/28
5,042,277 A * 8/1991 Jenn-Rong ..... 70/28
5,359,867 A * 11/1994 Ling et al. ..... 70/28
5,746,075 A * 5/1998 Yang ..... 70/25
5,765,409 A * 6/1998 Yang ..... 70/28
5,850,751 A * 12/1998 Kuo ..... 70/26
5,901,587 A * 5/1999 Chen ..... 70/28
5,918,489 A * 7/1999 Yang ..... 70/28
6,029,481 A * 2/2000 Lai ..... 70/25
6,082,155 A * 7/2000 Su ..... 70/22
6,381,997 B1 * 5/2002 Chen ..... 70/28

* cited by examiner

*Primary Examiner*—Suzanne Dino Barrett
(74) *Attorney, Agent, or Firm*—Troxell Law Office PLLC

(57) ABSTRACT

A numeral lock structure including: a lock main body in which a lock core is arranged, the lock core being controlled by multiple numeral wheels to lock or unlock; a lock hook having a base end and an extending free end, the base end being pivotally inserted in one end of the lock main body, whereby the free end of the lock hook can be freely rotated about the base end; and a displaceable button disposed on the lock main body for restricting the free end of the lock hook. Top side of the displaceable button is formed with a notch in which the free end of the lock hook is restricted in a locked state. When the lock core is locked, the displaceable button is synchronously restricted from displacing to keep locking the lock book. When the lock core is unlocked, the displaceable button is synchronously displaceable, permitting the free end of the lock hook to be turned outward and detach out from the notch for unlocking.

8 Claims, 5 Drawing Sheets

NUMERAL LOCK STRUCTURE

BACKGROUND OF THE INVENTION

The present invention is related to an improved numeral lock structure, and more particularly to a numeral lock having simple structure and can be conveniently operated to achieve better burglarproof effect.

In a conventional numeral lock, a lock core is disposed in a lock body. The lock core is connected with an outward extending U-shaped lock hook. A free end of the lock hook can be inserted and locked in the lock hole formed on the lock body. Multiple numeral wheels are fitted around the lock core. The numerals on the surfaces of the numeral wheels are exposed to outer side of the lock body. In use, the numeral wheels are turned to preset unlocking number to unlock the lock core. Then the lock hook is tracked outward to extract the free end of the lock hook from the lock hole. Such structure has some shortcomings as follows:

1. After the lock core is released from the locking of the numeral wheels, a user needs to hold the lock body with one hand and pull the lock hook with the other hand to extract the free end of the lock hook from the lock hole of the lock body. Therefore, the unlocking operation needs both hands to accomplish. This is inconvenient.
2. The lock hook is directly connected with the lock core which is restricted by the numeral wheels. Accordingly, a thief can continuously pull the lock hook and at the same time turn the respective numeral wheels. When the numeral wheels are positioned in the unlocking position (number), the lock core will loosen so that an unauthorized person can unlock the lock.
3. The lock hook and the lock core are synchronously driven. The sections of the numeral wheels engaged with the lock core have limited structural strength. Therefore, a thief can easily knock out the lock hook to damage the lock core. Accordingly, such lock structure has poor burglarproof effect.

SUMMARY OF THE INVENTION

It is therefore a primary object of the present invention to provide a numeral lock structure including: a lock main body in which a lock core is arranged, the lock core being controlled by multiple numeral wheels to lock or unlock; a lock hook having a base end and an extending free end, the base end being pivotally inserted in one end of the lock main body, whereby the free end of the lock hook can be freely rotated about the base end; and a displaceable button disposed on the lock main body for restricting the free end of the lock hook. Top side of the displaceable button is formed with a notch in which the free end of the lock hook is restricted in a locked state. When the lock core is locked, the displaceable button is synchronously restricted from displacing to keep locking the lock hook. When the lock core is unlocked, the displaceable button is synchronously displaceable, permitting the free end of the lock hook to be turned outward and detach out from the notch for unlocking. When the numeral wheels are turned to the correct number, the lock core is unlocked. At this time, a user can hold the lock main body and at the same time rotate the displaceable button to pen the lock hook with single hand. This is convenient to the user.

It is a further object of the present invention to provide the above numeral lock structure in which the displaceable button is substantially a rotary roller. One end of the displaceable button is formed with a notch tapered from one side to the center. A shaft section projects from the other end of the displaceable button into the lock main body. An acute projecting section is formed at an adjoining section between the shaft section and the displaceable button. The linking member is formed with a central through shaft hole. The circumference of the top side of the shaft hole is formed with a recessed section. A pressing section extends from a lateral edge of the linking member toward the lock core for pressing upper side of the lock core. When the lock core is unlocked, the displaceable button can be rotated. At this time, the acute projecting section of the displaceable button slides into or out of the recessed section of the linking member. When the acute projecting section slides out of the recessed section, the acute projecting section gradually presses down the linking member. After the notch of the displaceable button is turned to a direction to free the free end of the lock hook, the free end of the lock hook can be rotated to an unlocking position and detached out of the notch of the displaceable button for unlocking.

It is still a further object of the present invention to provide the above numeral lock structure in which the lock core and the lock hook are separate members without drivingly connecting with each other. Therefore, a thief cannot knock the lock hook to damage the lock core. Furthermore, when the numeral wheels are positioned in the unlocking position (number), the lock core will not loosen so that an unauthorized person cannot unlock the lock and a better burglaprpoof effect is achieved.

The present invention can be best understood through the following description and accompanying drawings wherein:

BRIEF DESCRIPTION OF THE DRAWINGS

FIG. 3A is a top view according to FIG. 3;

FIG. 4A is a top view according to FIG. 4;

DETAILED DESCRIPTION OF THE PREFERRED EMBODIMENTS

Figure 1:
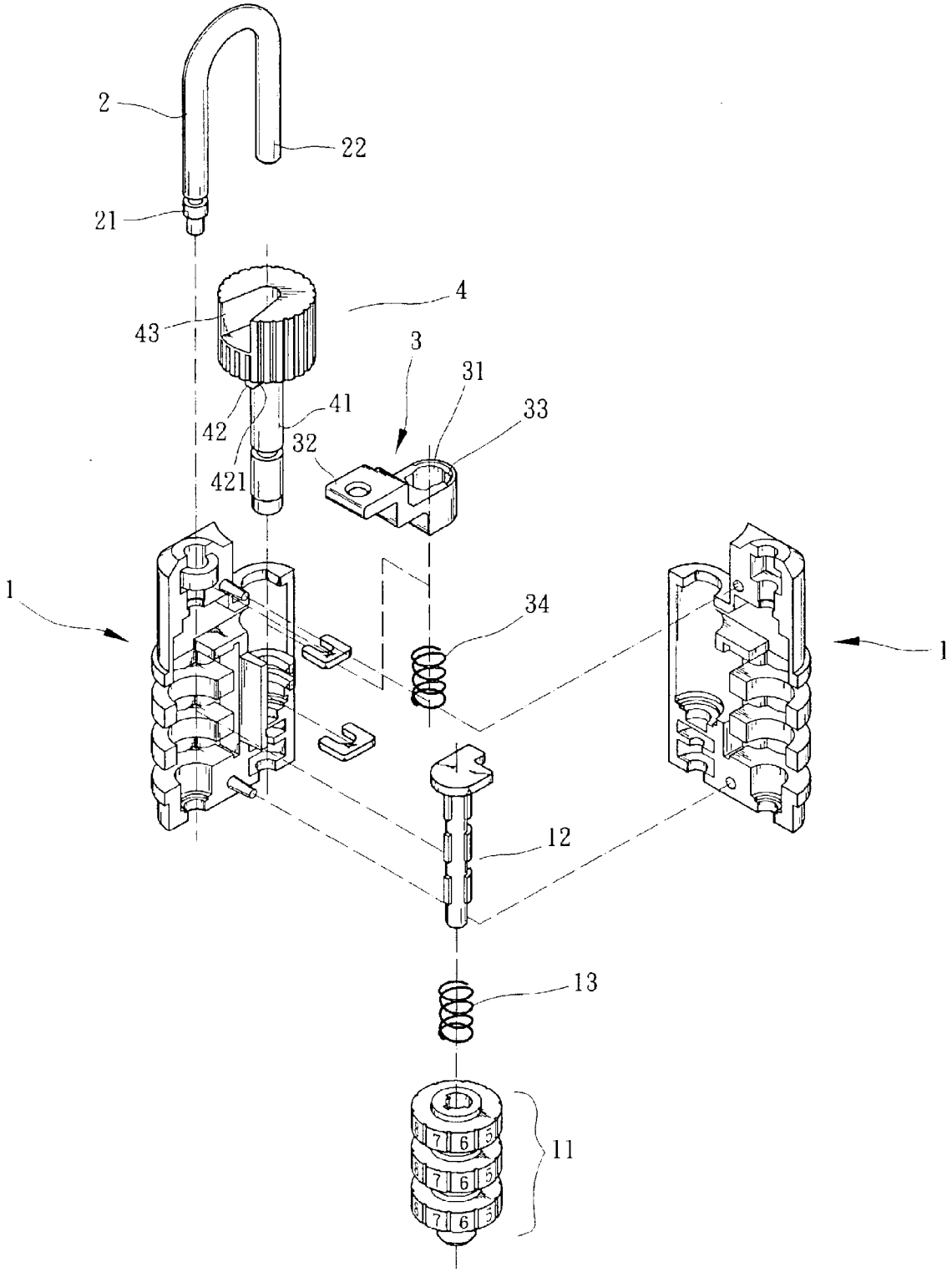
FIG. 1 is a perspective exploded view of a first embodiment of the present invention.

Please refer to FIG. 1 which shows a first embodiment of the present invention. The numeral lock includes a lock main body 1, a lock hook 2, a linking member 3 and a rotary displaceable button 4. A lock core 12 is arranged in the lock main body 1. Multiple numeral wheels 11 are fitted on the lock core 12. When the numeral wheels 11 are turned to the correct number, the lock core 12 can be unlocked and moved. A resilient member 13 such as a spring is fitted on the lock core 12. The resilient member 13 is compressed between the top end of the lock core 12 and the numeral wheels 11, whereby in normal state, the lock core 12 is resiliently forced to abut against the linking member 3. The lock hook 2 is substantially U-shaped and has a base end 21 and an extending free end 22. The base end 21 is pivotally inserted in one end of the lock main body 1, whereby the lock hook 2 can be freely rotated about the base end 21. The linking member 3 is formed with a central through shaft hole 31. The circumference of top side of the shaft hole 31 is formed with a redessed section 33. Two sides of the recessed section 33 are respectively formed with two lateral recessed slopes 331 which upward obliquely extend. In addition, a plane plate-like pressing section 32 extends from a lateral edge of the linking member 3 toward the lock core 12.

The top end of the rotary displaceable button 4 is substantially a roller. The roller is formed with a notch 43 tapered from one side to the center. A shaft section 41 projects from lower end of the roller. An acute projecting section 42 corresponding to the recessed section 33 is formed at an adjoining section between the shaft section 41 and the roller. Two sides of the acute projecting section 42 are formed with lateral projecting slopes 421 corresponding to the lateral recessed slopes 331.

Figure 2:
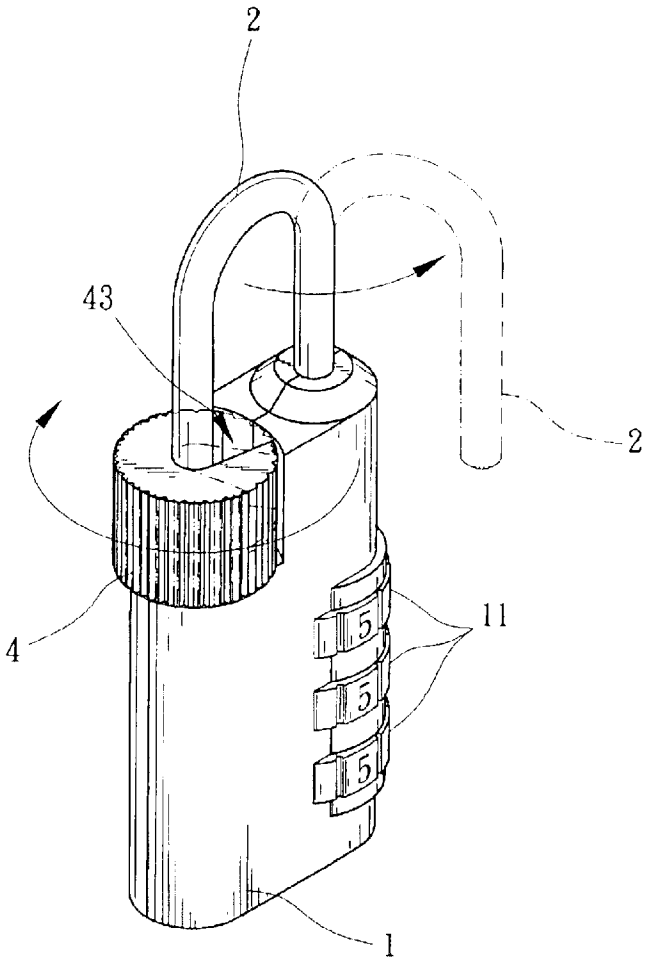
FIG. 2 is a perspective assembled view of the first embodiment of the present invention.
Figure 3:
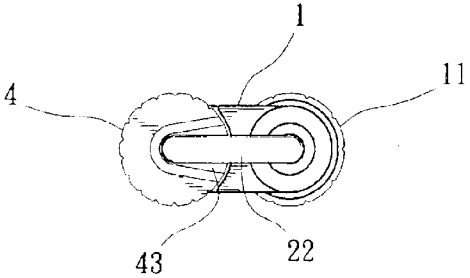
FIG. 3 is a sectional view of the first embodiment of the present invention in a locked state.
Figure 3:
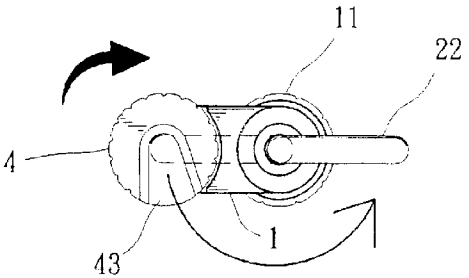
Figure 3:
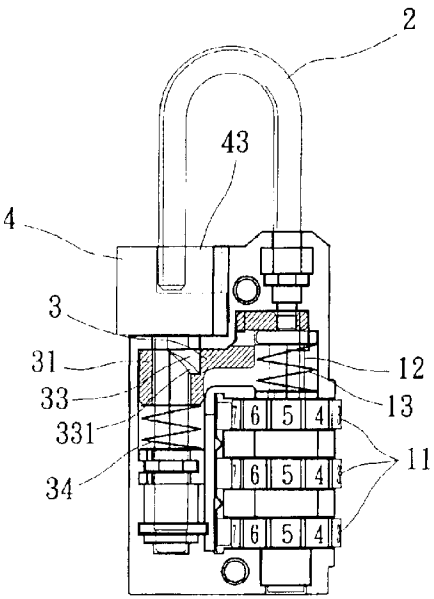

FIG. 2 is a perspective assembled view according to FIG. 1. Also with reference to FIGS. 3 and 3A, when assembled, the linking member 3 and the lock core 12 are disposed in the lock main body 1 on different sides thereof. The pressing section 32 of the linking member 3 extends to upper side of the lock core 12 to press the same. The shaft section 41 of the displaceable button 4 is inserted into the lock main body 1 and rotatably passed through the shaft hole 31 of the linking member 3. A resilient member 34 such as a spring is disposed between the linking member 3 and the inner side of the lock main body 1 near the tail end of the shaft section 41. The resilient member 34 makes the linking member 3 naturally attach to the end of the lock main body in which the displaceable button 4 is inserted. The acute projecting section 42 of the displaceable button 4 is totally inlaid in the recessed section 33 of the linking member 3. The notch 43 of top side of the displaceable button 4 is kept in a closed position to restrict the movement of the free end 22 of the lock hook 2. Accordingly, when the numeral wheels 11 are in the locking position (incorrect unlocking number), the lock core 12 is engaged and cannot be pressed down. At this time, the lock core 12 abuts against the linking member 3 to prevent the linking member 3 from descending. Therefore, the displaceable button 4 is restricted from moving, that is, the displaceable button 4 cannot be turned so that the free end 22 of the lock hook 2 is still restricted by the displaceable button 4 from rotating out for unlocking.

Figure 4:
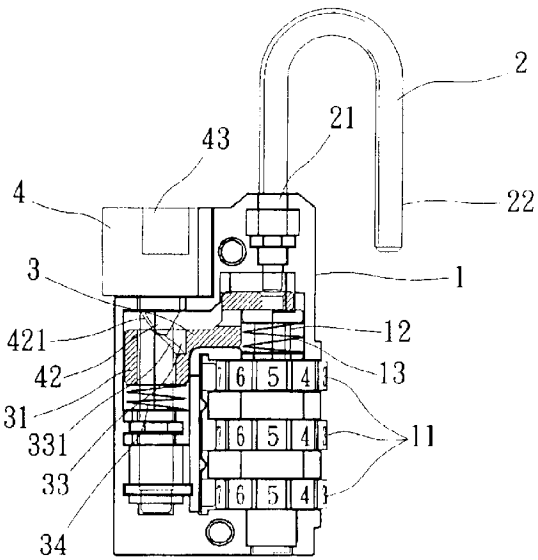
FIG. 4 is a sectional view of the first embodiment of the present invention in an unlocked state.

FIGS. 4 and 4A show the unlocking operation of the first embodiment of the present invention. When the numeral wheels 11 are turned to the unlocking number, the lock core 12 is released from the engagement. At this time, the lock core 12 can be pressed down. When rotating the displaceable button 4, the acute projecting section 42 of the displaceable button 4 downward slides along the lateral recessed slopes 331 of the recessed section 33 to press down the top side of the linking member 3. Accordingly, the bottom end of the linking member 3 compresses the resilient member 34 and moves downward. At the same time, the pressing section 32 downward presses the lock core 12 (and the resilient member 13). After the displaceable button 4 is rotated by about 90 degrees, the notch 43 of top side of the displaceable button 4 is turned to a direction to free the free end 22 of the lock hook 2, whereby the free end 22 of the lock hook 2 can be rotated to an unlocking position and detached out of the notch 43 of the displaceable button 4 (as shown by phantom line of FIG. 2 and FIG. 4A).

Figure 5:
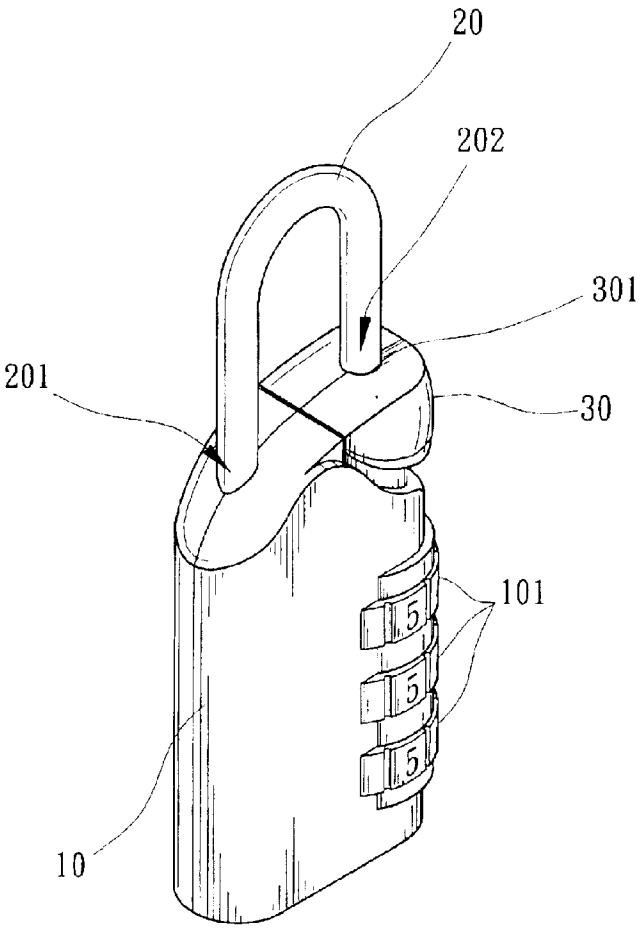
FIG. 5 is a perspective assembled view of a second embodiment of the present invention.
Figure 6:
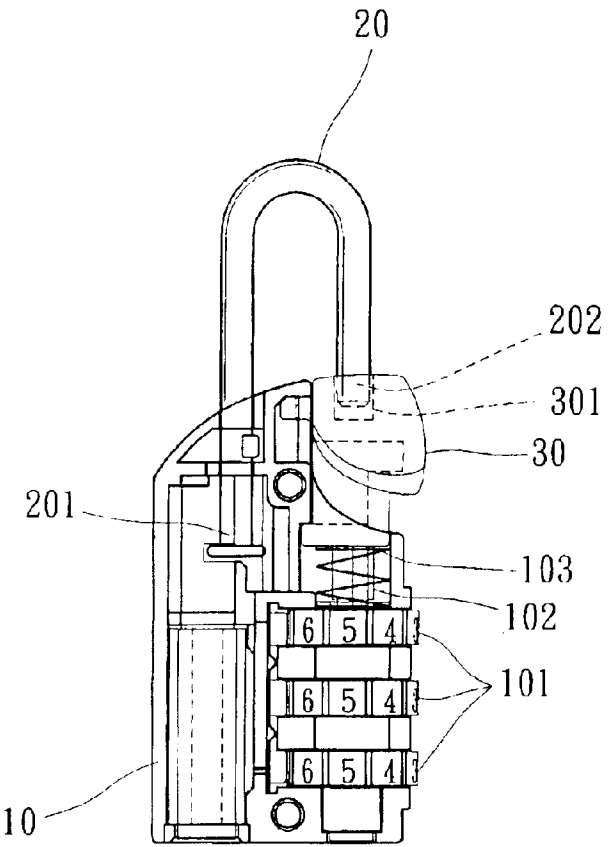
FIG. 6 is a sectional view of the second embodiment of the present invention in a locked state.

FIGS. 5 and 6 show a second embodiment of the present invention, in which the lock core 102 is disposed in the lock main body 10 and controllable by the numeral wheels 101. The lock core 102 is drivingly connected with a displaceable button 30 extending out from upper end of the lock main body 10. A resilient member 103 resiliently forces the displaceable button 30 outward. An outer side of the top of the displaceable button 30 is formed with a lock hole 301. A lock hook 20 is disposed on upper end of the lock main body 10. A base end 201 of the lock hook 20 is pivotally inserted in the lock main body 10, whereby the lock hook 20 can be rotated about the base end 201. The other end of the lock hook 20 is a free end 202 which can be inserted into the lock hole 301 of the displaceable button 30 in natural state. When the numeral wheels 101 are positioned in locked position, the lock core 102 is engaged and prevented from moving. The top end of the lock core 102 abuts against the bottom end of the displaceable button 30 extending into the lock main body 10, whereby the free end 202 of the lock hook 2 is securely fitted and locked in the lock hole 301 of the displaceable button 30.

Figure 7:
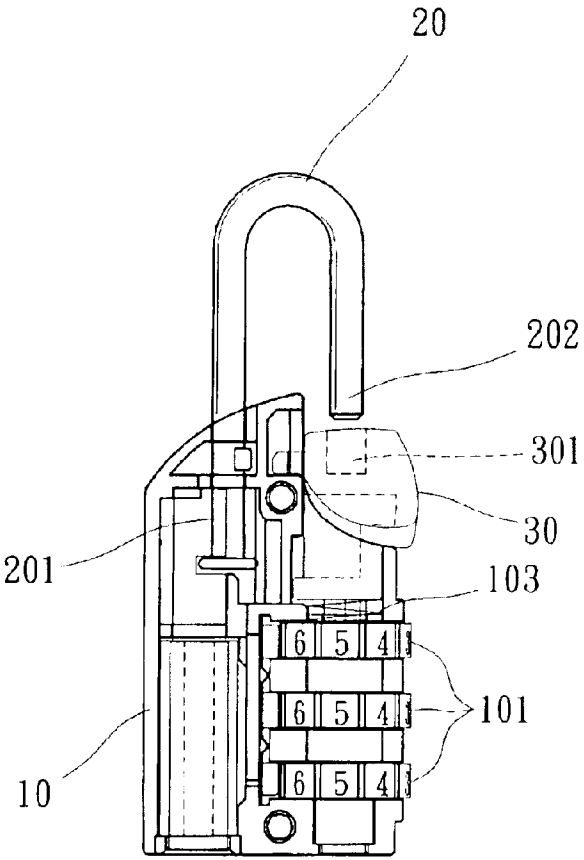
FIG. 7 is a sectional view of the second embodiment of the present invention in an unlocked state.

FIG. 7 shows the unlocking operation of the second embodiment. When the numeral wheels 101 are turned to the unlocking position, the lock core 102 is released from the restriction. At this time, the displaceable button 30 can be pressed to detach the free end 202 of the lock hook 20 out of the lock hole 301 of the displaceable button 30. Under such circumstance, the lock hook 20 can be freely rotated to an open position.

In the above embodiments, the lock core and the lock hook are separate members so that a thief cannot knock the lock hook to damage the lock core. Furthermore, a user can hold the lock main body and at the same time turn the numeral wheels and rotate the displaceable button (first embodiment) to open the lock hook with single hand. Alternatively, a user hold the lock main body and press the displaceable button (second embodiment) to open the lock hook with single hand. This is convenient to the user.

The above embodiments are only used to illustrate the present invention, not intended to limit the scope thereof. Many modifications of the above embodiments can be made without departing from the spirit of the present invention.

What is claimed is:

1. A numeral lock structure comprising:

a lock main body in which a lock core is arranged, the lock core being controlled by multiple numeral wheels to lock or unlock;

a lock hook having a middle bent section and a base end and an extending free end, the base end being pivotally inserted in one end of the lock main body, whereby the lock hook can be directly freely rotated about the base end without axially moving; and a displaceable button disposed on the lock main body in a position where the free end of the lock hook is turned in or out, whereby in accordance with the locked state or unlocked state of the lock core, the displaceable button is synchronously positioned in a not displaceable state or a displaceable state, the displaceable button being formed with a notch corresponding to the free end of the lock hook for restricting the same, whereby when the lock core is locked, the displaceable button is synchronously restricted from displacing to keep locking the lock hook, while when the lock core is unlocked, the displaceable button is synchronously in a displaceable state and is displaced, permitting the free end of the lock hook to be turned outward and detach from the notch for unlocking, wherein a linking member is connected between the displaceable button and the lock core for synchronously drivingly connecting the displaceable button and the lock core, wherein the linking member is formed with a central through shaft hole, a circumference of top side of the shaft hole being formed with a recessed section, a pressing section extending from a lateral edge of the linking member toward the lock core for pressing upper side of the lock core.

2. The numeral lock structure as claimed in claim 1, wherein the displaceable button is substantially a rotary roller, one end of the displaceable button being formed with a notch tapered from one side to the center, a shaft section projecting from the other end of the displaceable button into the lock main body, the shaft section being inserted in the lock main body and fitted through the shaft hole of the linking member, whereby the displaceable button is rotatable about the shaft section, an acute projecting section being formed at an adjoining section between the shaft section and the displaceable button, whereby when the displaceable button is rotated, the acute projecting section of the displaceable button slides into or out of the recessed section of the linking member and when the acute projecting section slides out of the recessed section, the acute projecting section gradually presses down the linking member for unlocking.

3. The numeral lock structure as claimed in claim 1, wherein the displaceable button is substantially a rotary roller, one end of the displaceable button being formed with a notch tapered from one side to the center, a shaft section projecting from the other end of the displaceable button into the lock main body, the shaft section being inserted in the lock main body and fitted through the shaft hole of the linking member, whereby the displaceable button is rotatable about the shaft section, an acute projecting section being formed at an adjoining section between the shaft section and the displaceable button, whereby when the displaceable button is rotated, the acute projecting section of the displaceable button slides into or out of the recessed section of the linking member and when the acute projecting section slides out of the recessed section, the acute projecting section gradually presses down the linking member for unlocking.

4. The numeral lock structure as claimed in claim 1, wherein two sides of the recessed section of the linking member are formed with a lateral slope which upward obliquely extend, whereby when turning the displaceable button, the acute projecting section of the displaceable button laterally slides.

5. The numeral lock structure as claimed in claim 2, wherein two sides of the acute projecting section are formed with lateral projecting slopes which upward obliquely extend.

6. The numeral lock structure as claimed in claim 3, wherein two sides of the acute projecting section are formed with lateral projecting slopes which upward obliquely extend.

7. The numeral lock structure as claimed in claim 2, wherein a resilient member is disposed between the shaft section of the displaceable button and the linking member to resiliently abut against the linking member, whereby the acute projecting section of the displaceable button can be tightly fitted in the recessed section of the linking member.

8. The numeral lock structure as claimed in claim 3, wherein a resilient member is disposed between the shaft section of the displaceable button and the linking member to resiliently abut against the linking member, whereby the acute projecting section of the displaceable button can be tightly fitted in the recessed section of the linking member.

* * * * *